US007354171B2

(12) United States Patent
Pazula et al.

(10) Patent No.: US 7,354,171 B2
(45) Date of Patent: Apr. 8, 2008

(54) WRAP LIGHTING FIXTURE

(75) Inventors: Bruce Raymond Pazula, Broadview Heights, OH (US); Joseph John Janos, Wadsworth, OH (US)

(73) Assignee: The L.D. Kichler Co., Cleveland, OH (US)

( * ) Notice: Subject to any disclaimer, the term of this patent is extended or adjusted under 35 U.S.C. 154(b) by 218 days.

(21) Appl. No.: 11/033,037

(22) Filed: Jan. 11, 2005

(65) Prior Publication Data

US 2006/0152919 A1 Jul. 13, 2006

(51) Int. Cl.
*F21V 33/00* (2006.01)
*F21S 8/00* (2006.01)

(52) U.S. Cl. ..... 362/135; 362/140; 362/147

(58) Field of Classification Search ..... 362/128, 362/129, 135, 136, 403, 140, 147
See application file for complete search history.

(56) References Cited

U.S. PATENT DOCUMENTS

| | | | | |
|---|---|---|---|---|
| D40,215 | S | | 8/1909 | Pitner |
| D40,216 | S | | 8/1909 | Pitner |
| D40,218 | S | | 8/1909 | Pitner |
| 977,355 | A | | 11/1910 | Williams |
| 1,024,369 | A | | 4/1912 | Sechrist |
| 1,091,961 | A | | 3/1914 | Ratto |
| 1,380,144 | A | | 5/1921 | Harvey |
| D64,986 | S | | 6/1924 | Klein |
| 1,820,348 | A | | 8/1931 | Corwin et al. |
| 1,910,435 | A | * | 5/1933 | Henkel ..... 362/129 |
| 2,223,943 | A | | 12/1940 | Miller |
| D177,294 | S | | 3/1956 | Willis |
| D187,999 | S | | 5/1960 | Willis |
| RE25,402 | E | | 6/1963 | Myerberg |
| D200,590 | S | | 3/1965 | Steenhoven |
| 3,737,646 | A | * | 6/1973 | Burrows ..... 362/140 |
| 4,047,016 | A | | 9/1977 | Palka |
| 4,605,995 | A | * | 8/1986 | Pike ..... 362/287 |
| D320,465 | S | | 10/1991 | Sonneman |
| D340,780 | S | | 10/1993 | Porter |
| D356,383 | S | | 3/1995 | Pickett |
| D356,384 | S | | 3/1995 | Pickett |
| 5,488,548 | A | | 1/1996 | Kwong |
| D367,335 | S | | 2/1996 | Kay |
| D369,428 | S | | 4/1996 | Deron |
| 5,541,819 | A | | 7/1996 | Kwong et al. |
| D385,380 | S | | 10/1997 | Porter et al. |
| D391,662 | S | | 3/1998 | Miranda |

(Continued)

OTHER PUBLICATIONS

Product Information, Model Numbers F4800-36 and F4820-36, p. 112, Forecast Lighting Catalog, Jan. 2004.

*Primary Examiner*—John Anthony Ward
(74) *Attorney, Agent, or Firm*—Calfee, Halter & Griswold LLP

(57) ABSTRACT

A new lighting fixture is provided for illuminating a mirror or the like while creating the impression and feel of multiple swag lamps suspended on each side of the mirror. The fixture includes a pair of side lamp assemblies each of which is suspended from a corresponding support arm projecting from a mounting assembly positioned above and at the approximate center of the mirror. To provide compact shipping and easy assembly in the field, the side lamp assemblies are suspended by carrier links which are attached to their associated support arms by quick-fit non-screw unions.

20 Claims, 9 Drawing Sheets

U.S. PATENT DOCUMENTS

| | | | |
|---|---|---|---|
| D399,330 | S | 10/1998 | Geier et al. |
| D416,643 | S | 11/1999 | Benghozi |
| D425,236 | S | 5/2000 | Porter et al. |
| D446,337 | S | 8/2001 | Benghozi |
| D447,595 | S | 9/2001 | Bandini |
| D450,875 | S | 11/2001 | Yang |
| D464,758 | S | 10/2002 | Lee |
| D465,595 | S | 11/2002 | Hoernig |
| D493,560 | S | 7/2004 | Parres |
| 2003/0133287 | A1 | 7/2003 | Chen |

* cited by examiner

WRAP LIGHTING FIXTURE

The present invention relates to a new lighting fixture which is intended to be used for lighting a mirror or similar structure while creating the impression and feel of multiple swag lamps suspended on each side of the mirror.

Thus, the present invention provides a new lighting fixture that may be used for illuminating a mirror or the like mounted on a wall, the fixture comprising a mounting assembly for mounting the fixture to the wall above and at the approximate center of the mirror, left and right support arms being spaced from the wall and carried by the mounting assembly, a pair of side lamp assemblies, one side lamp assembly being suspended on each side of the mirror, and a pair of carrier links, each carrier link supporting an associated side lamp assembly, each carrier link being mechanically attached to its associated support arm by a quick-fit non-screw union.

BRIEF DESCRIPTION OF THE DRAWINGS

The present invention may be more readily understood by reference to the following drawings wherein.

DETAILED DESCRIPTION

Figure 1:
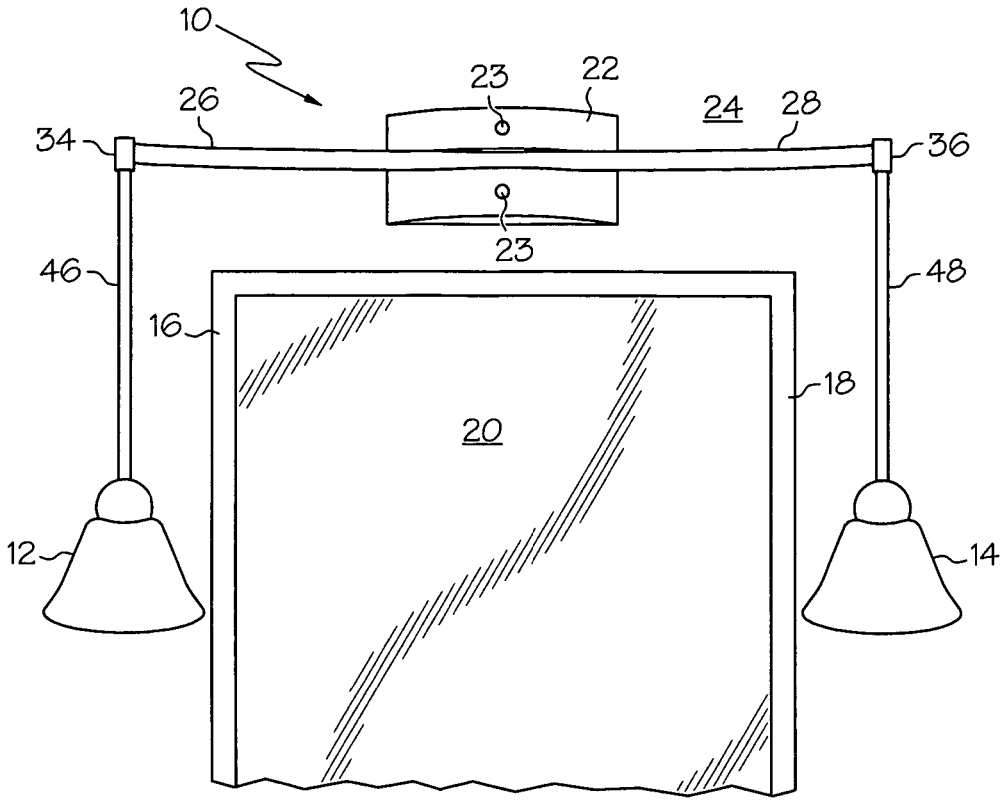
FIG. 1 is a front view of one embodiment of the inventive lighting fixture shown in position on a wall next to a mirror.
Figure 2:
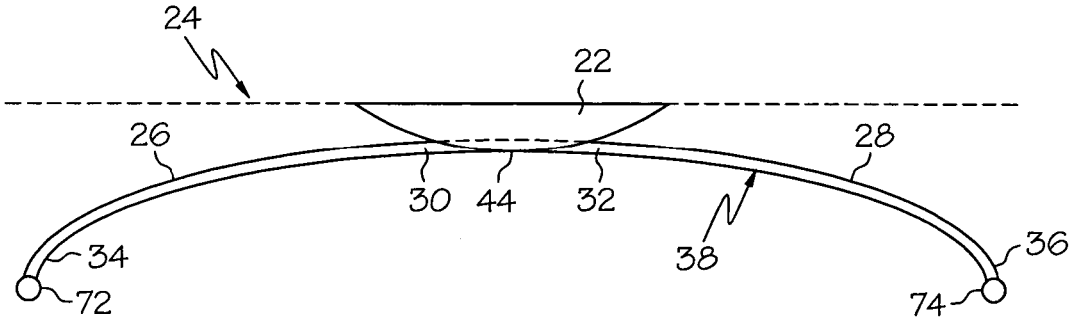
FIG. 2 is a top plan view of the mounting assembly and support arms of the lighting fixture of FIG. 1.
Figure 3:
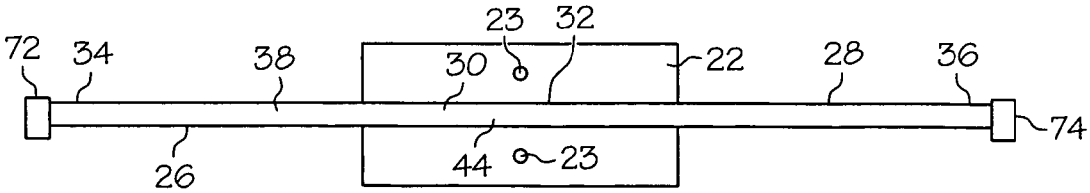
FIG. 3 is a front elevational view of the mounting assembly and support arms of FIG. 2.

As shown in FIGS. 1-3, a first exemplary lighting fixture 10 in accordance with the present invention includes a pair of side lamp assemblies 12 and 14 which are contiguous the left side 16 and the right side 18, respectively, of mirror 20 (or the like, e.g., a framed photograph, a framed painting, another framed image, a window (on an inside wall or an outside wall), etc.). In exemplary applications, such a mirror may be in a bathroom, a foyer, or a bar area. The lamp assemblies 12, 14 may be so-called mini-pendants and may also include a socket for a light bulb, a shade (diffuser), and associated mounting hardware. For this purpose, lighting fixture 10 includes mounting assembly 22 which is attached to wall 24 on which the mirror is mounted above and at the approximate center of the mirror. Most commonly, mounting assembly 22 will be attached to an electrical junction box (not shown) of wall 24 which junction box includes one or more wires for connecting lighting fixture 10 to a source of electricity. The mounting assembly 22 may be affixed to the wall 24 via any number of suitable fasteners, e.g., via slotted knurl finial balls 23 connected to a mounting plate (not shown).

In order to provide the impression and feel of multiple swag lamps, side lamp assemblies 12 and 14 are suspended by lighting fixture 10 so that the lamp sockets inside these lamp assemblies (not shown) are located at least about 6 inches, more typically at least about 12 inches or even at least about 18 inches below the center of the junction box or other location where mounting assembly 22 is attached to wall 24.

For this purpose, the inventive lighting fixture is provided with left and right support arms 26 and 28 whose proximal ends 30 and 32, respectively, are attached to mounting assembly 22 so that each support arm—and thus each side lamp assembly 12, 14—is spaced from wall 24. In the particular embodiment shown, support arms 26 and 28 are formed from a single, continuous unitary support rod 38 which is curved in configuration so that its left and right (or distal) ends 34 and 36 extend out from wall 24 by a greater distance than body section 44 of the support rod which is attached to mounting assembly 22. Other configurations and structures are also possible, as further discussed below.

In order to support side lamp assemblies 12 and 14 in their desired locations, a pair of carrier links 46 and 48 are provided. These carrier links may take essentially any form such as solid or hollow rods or bars of any cross-section, chains, wires, etc. Electrical conductors (e.g., wires shown in FIGS. 4B and 12C) may pass from mounting assembly 22 through support arms 26, 28 and through carrier links 46, 48 to side lamps 12, 14.

In order that the inventive light fixture can be stored and shipped in a compact configuration and then easily assembled in the field, carrier links 46 and 48 are mechanically connected to support arms 26 and 28 by removable connections, e.g., quick-fit non-screw unions. In this context, a "quick-fit non-screw union" is a mechanical union which can be assembled easily in the field and without twisting the carrier link by more than one full revolution. In accordance with the invention screw-type unions, i.e. unions in which one of the parts to be joined must be rotated with respect to the other by more than one revolution, are avoided in order that excessive twisting of the electrical wire or wires inside the fixture is prevented.

Examples of quick-fit non-screw unions useful in accordance with the present invention include snap-fit unions, pin-fit unions (i.e. unions in which a set screw or other movable pin is moved into and out of a corresponding detent or groove in the piece to be joined), bayonet-fit unions and hook and loop unions such as occurs when the link of a chain is received by a hook. Any other mechanical union which can be easily accomplished without rotation of the carrier links with respect to their respective support arms by more than one revolution can also be used.

In the particular embodiment of FIGS. 1-3, the electrical wires connecting side lamp assemblies 12 and 14 to a source of electrical power are hidden from view. For this purpose support arms 26 and 28 as well as carrier links 46 and 48 are hollow, while the upper ends of carrier links 46 and 48 are received in downwardly facing openings (FIG. 4B) in support arms 26 and 28. In addition, for economies of production as well as a pleasing appearance, the regions of support arms 26 and 28 which define these downwardly facing openings have a closed-wall construction.

In this context, a "closed-wall construction" means that access to the interior of the support arm in the regions which define the downwardly facing openings is prevented as a practical matter. Thus, for example, there is no open end of the support rod, nor are there other openings in the walls of the support arms, which would allow an installer to access the inside of the support arms to attach a fastener from inside the support arm, as a practical matter. This is illustrated, for example, in FIGS. 1-3, which shows that the only openings in the vertically-oriented cylinders 72 and 74 which form distal ends 40 and 42 of support arms 26 and 28 are the downwardly facing openings in the bottom faces of these cylinders for receiving carrier links 46 and 48 (and perhaps also bores 75' for set screws 76' shown in FIG. 4B). The remainder of these cylinders, i.e., their side walls and top surfaces, are permanently closed. Nor are there any other such openings in the support arms in the vicinity of these cylinders either. Thus, a nut or other fastener could not be attached to a carrier link from inside these cylinders, as a practical matter.

Figure 4A:
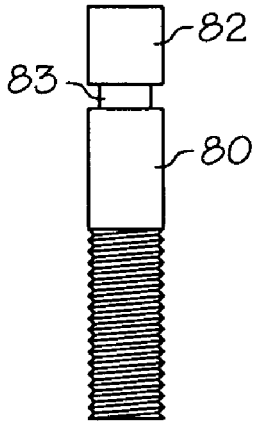
FIG. 4A illustrates an exemplary different quick-fit non-screw union that can be used for joining the carrier links to the associated support arms of the inventive lighting fixtures.
Figure 4B:
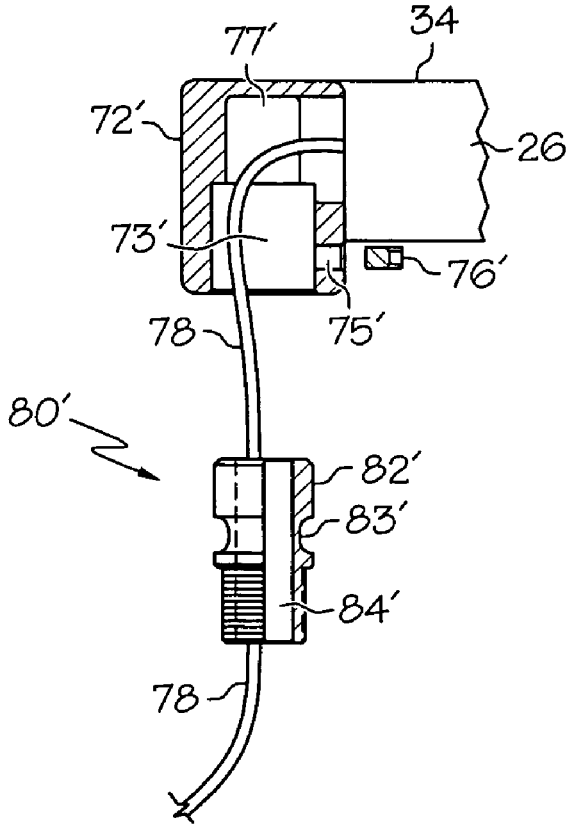
FIG. 4B illustrates a partial cross sectional exploded view of an exemplary implementation of the quick-fit non-screw union of FIG. 4A in relationship with an exemplary support arm end.

Although a quick-fit non-screw union can be machined or otherwise formed in the workpieces which make up support arms 26 and 28 and carrier links 46 and 48, providing such unions can most easily be done by forming the union via an adapter, such as a hollow nipple or other detachable element and then attaching the adapter to the carrier links or the support arms before they are joined together. This is illustrated in FIGS. 4A, 4B, 5, and 6, which show exemplary adapters that can be used for this purpose, which adapters may be affixed to an appropriate portion of support arms 26 and 28 and/or carrier links 46 and 48, with the other having an appropriate mating portion, e.g., an opening accepting and retaining the adapter, all of which may be considered to be means for connection to and support of a respective carrier link via a quick-fit non-screw union. In particular, FIG. 4 shows an exemplary hollow nipple 80 whose upper end 82 defines a pin-fit union in that it includes a groove 83 for receiving a set screw or other movable pin (not shown) carried by cylinders 72 and 74 of support arms 26 and 28. FIG. 4B shows an exemplary implementation of the adapter of FIG. 4A. More specifically, FIG. 4B shows exemplary cylinder 72' having an opening 73' that accepts exemplary hollow nipple 80'. Opening 73'has an axial opening 75' that accepts a set screw 76' to retain the hollow nipple 80' in place. Opening 73' is also connected by opening 77' to the hollow of support arm 26 through which wiring 78 may extend. Similarly, hollow nipple 80' has an opening 84' through which wiring 78 may extend to a carrier link 46, 48. Hollow nipple 80' has an upper end 82' that defines a pin-fit union in that it includes a groove 83' for receiving set screw 76' or another movable pin (not shown) carried by cylinder 72' of support arm 26. Support arm 28 may use a similar (mirror image) cylinder 74' and similar adapter 80'.

Figure 5:
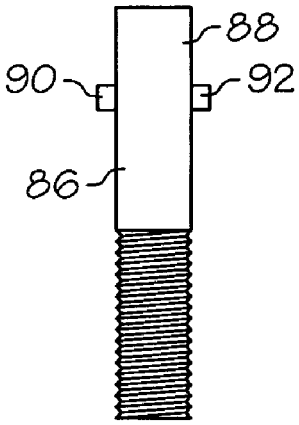
FIGS. 5 and 6 illustrate other exemplary quick-fit non-screw unions that can be used for joining the carrier links to the associated support arms of the inventive lighting fixtures.
Figure 6:
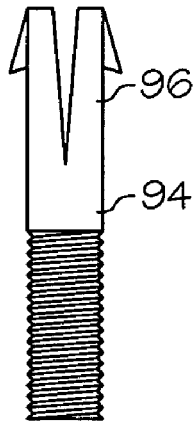

FIG. 5 shows another exemplary hollow nipple 86 whose upper end 88 provides a bayonet-type union in that it includes protrusions 90 and 92 for being received in and secured by a corresponding detent and groove arrangement (not shown) in cylinders 72 and 74. FIG. 6, meanwhile, shows yet another exemplary hollow nipple 94 whose upper end 96 is bifurcated and notched so it can be snap-fit into a corresponding recess (not shown) in cylinders 72 and 74.

As shown in each of FIGS. 4A, 4B, 5, and 6 the lower end of each adapter may be threaded so that it can be screwed into corresponding threaded openings in either cylinders 72 and 74, or carrier links 46 and 48. It will therefore be appreciated that, even though hollow nipples 80, 86 and 94 include threaded sections which must be screwed into support arms 26 and 28 or carrier links 46 and 48, the junctions formed by these hollow nipples are nonetheless "quick-fit non-screw unions" in the context of this case. This is because the actual joining of a carrier link and support arm equipped with one of these nipples does not require rotation of the carrier link by more than one revolution. Rather, any such rotation to connect an adapter to either the carrier links or the support arms would typically be done before the support arm and carrier link are joined to one another.

In the alternative, each carrier link 46, 48 may have a quick-fit non-screw union formed integrally therewith or permanently affixed thereto (such as a groove 83, 83'), for connection to a corresponding support arm 26, 28 without use of a separate adapter. In the alternative, the end of each support arm may have a quick-fit non-screw union formed integrally therewith or permanently affixed thereto, for connection to a corresponding carrier link 46, 48 without use of a separate adapter.

A typical assembly for the embodiments of FIGS. 1-6 might include the steps of: (a) threading side lamp assembly wiring through a corresponding carrier link and connecting the side lamp assembly to the corresponding carrier link (if necessary); (b) threading the side lamp assembly wiring through a corresponding adapter (e.g., one of the hollow nipples shown in FIGS. 4-6) and connecting the carrier link to the corresponding adapter (if necessary); these first two steps being in either order; and then (c) threading the side lamp assembly wiring through the distal opening of a corresponding fixture arm and connecting the carrier link to the distal end of the fixture arm. If the adapter of FIG. 4A or FIG. 4B is used (or a carrier link with an integral groove 83, 83'), this last step may comprise the steps of: inserting an end of the side lamp assembly wiring 78 into opening 73' of the arm 26; pushing the wiring 78 through opening 77' and through a hollow of arm 26 until the wiring may be accessed proximate the mounting assembly 22; pulling the end of wiring 78 from a point proximate the mounting assembly 22 until the adapter 80' at the end of the carrier link 46 is near the opening 73'; aligning the adapter 80' with the opening 73'; inserting the adapter 80' into the opening 73'; inserting set screw 76' into opening 75' until set screw 76' is far enough into groove 83' of adapter 80' to hold the adapter 80', carrier link 46, and side lamp assembly in place (but perhaps not so tight that it prevents the side lamp assembly from being rotated to a desired orientation); connecting wiring 78 to wiring from wall 24; and mounting the mounting assembly to wall 24, perhaps via a mounting plate connected to a junction box. Optional subsequent steps may include rotating the side lamp assembly to a desired orientation and perhaps tightening the set screw to maintain that orientation.

Figure 7:
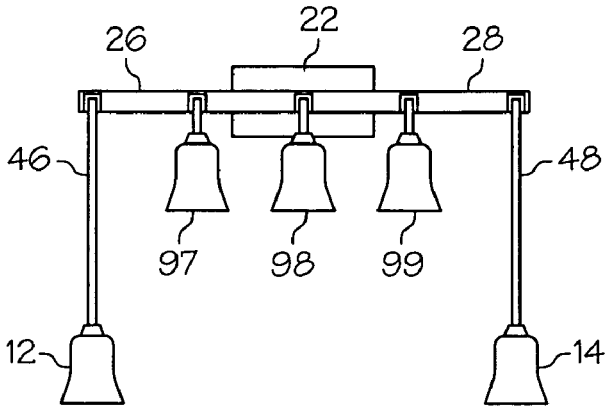
FIG. 7 illustrates another embodiment of the invention in which the lighting fixture of FIGS. 1-3 is provided with interior lighting assemblies in addition to side lighting assemblies.
Figure 14:
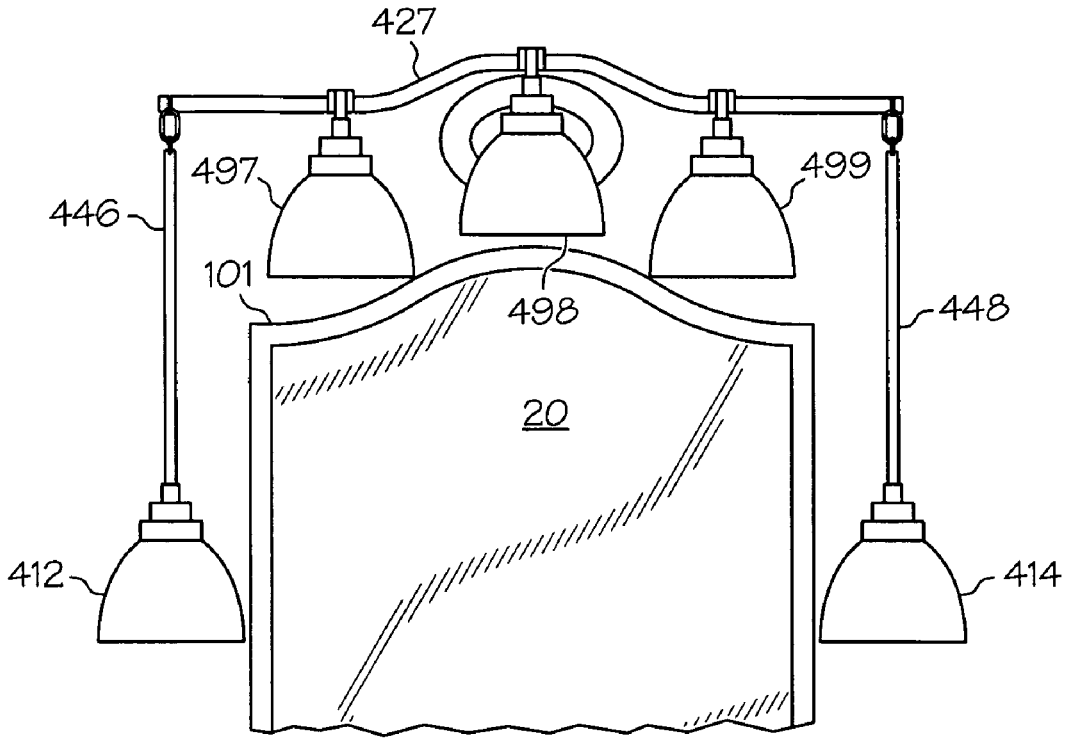
Figure 15:
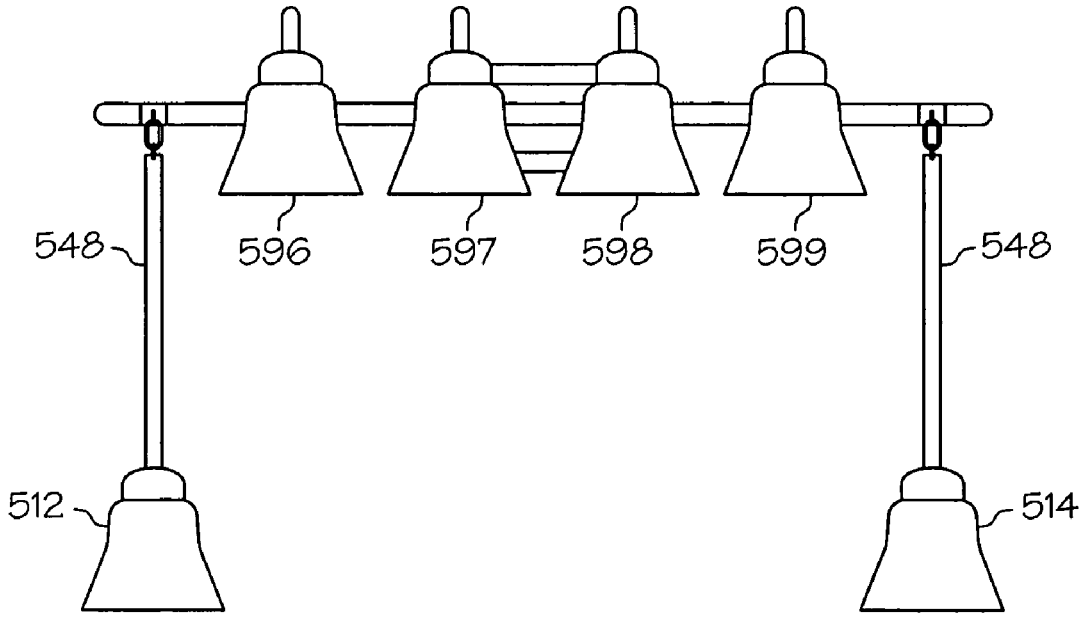

FIG. 7 shows another embodiment of the invention in which the inventive lighting fixture includes one, two, three, four or more interior lamp assemblies 97, 98 and 99 attached to support arms 26 and 28 for spacing contiguous the top 101 of mirror 20 (See, FIG. 14).

Figure 11:
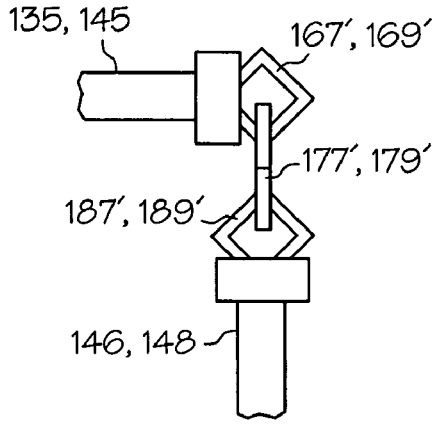
FIG. 11 is a partial view showing a carrier link supporting one of the side lighting assemblies of the lighting fixture of FIGS. 8 and 9 being attached to its associated support arm by another exemplary chain link.
Figure 10A:
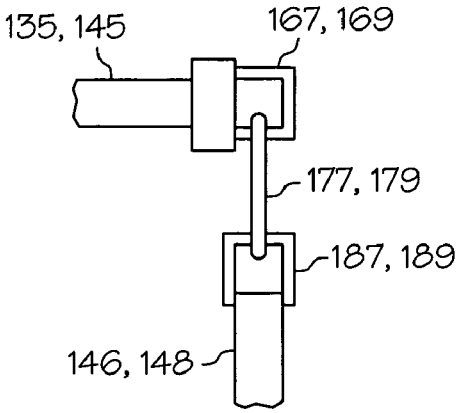
FIGS. 10A and 10B are partial views showing a carrier link supporting one of the side lighting assemblies of the lighting fixture of FIGS. 8 and 9 being attached to its associated support arm by an exemplary chain link.
Figure 10B:
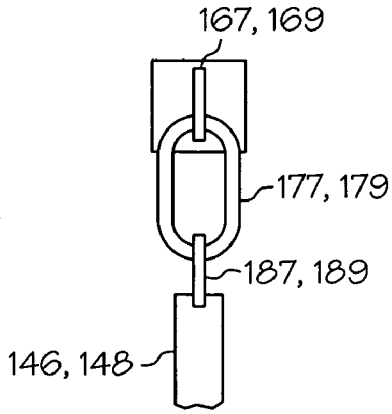
Figure 8:
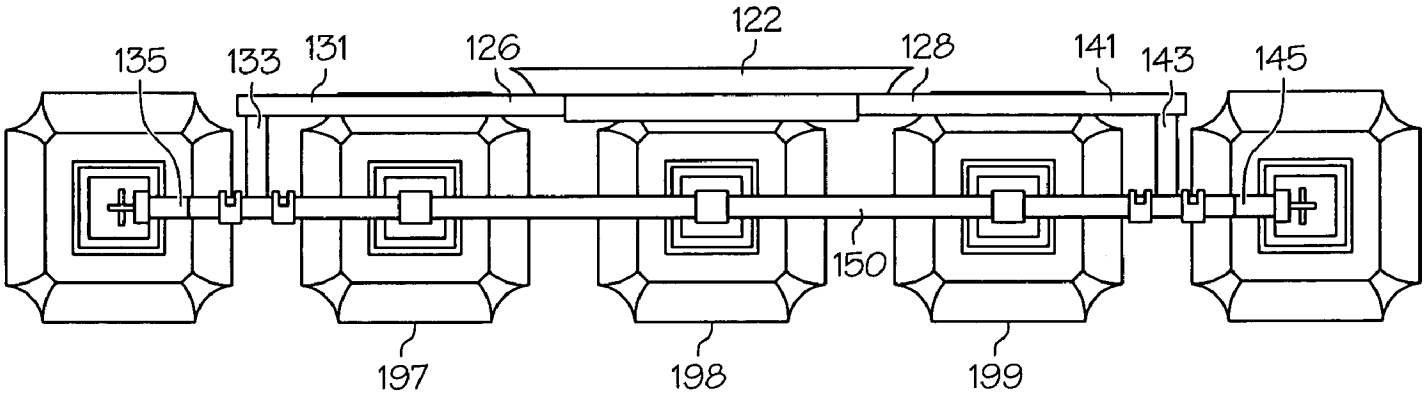
FIGS. 8 and 9 are top and side views of another embodiment of the inventive lighting fixture in which interior lighting assemblies are carried by a support rod mounted between the distal ends of the support arms.
Figure 9:
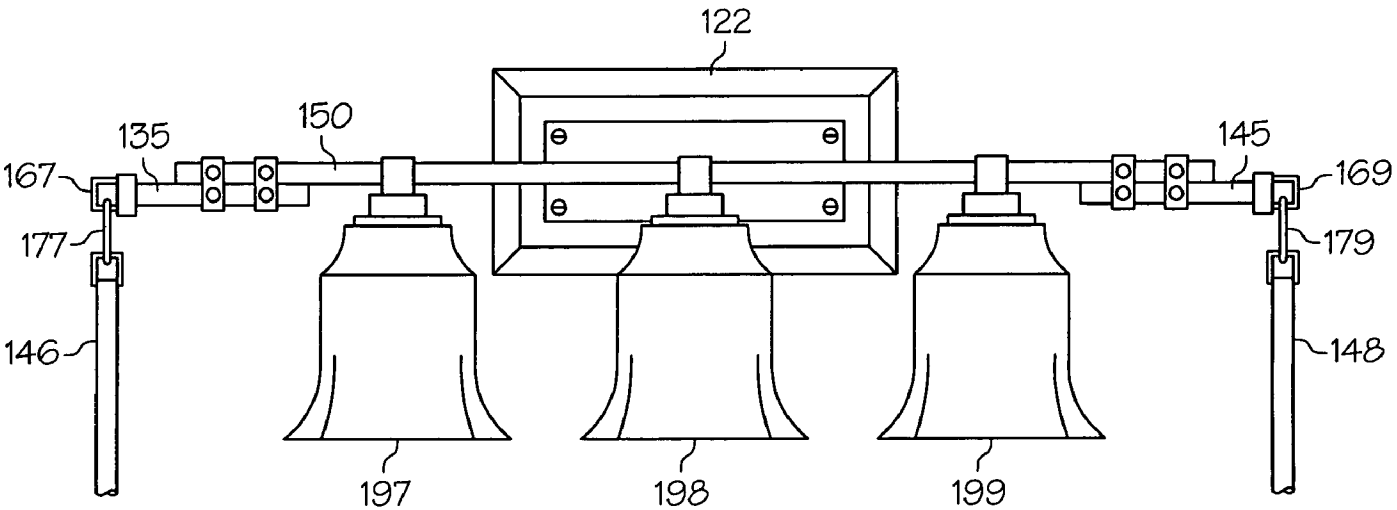

Still another embodiment of the inventive lighting fixture is shown in FIGS. 8 and 9 in which support arms 126 and 128 extending from mounting assembly 122 are formed by arm sections 131/133/135 and 141/143/145, respectively, with a secondary support rod 150 extending between the distal ends 135 and 145 of these support arms. Note that in this embodiment, interior lamp assemblies 197, 198 and 199 are carried by secondary support rod 150 rather than support arms 126 and 128. FIGS. 10A and 10B show that, in this particular embodiment, carrier links 146 and 148 may be secured to the distal ends 135 and 145 of the support arms by a hook and link arrangement defined by hooks 167, 169, 187, 189 and rings 177 and 179. The hooks 167, 169 and/or 187, 189 may be either closed (as shown) or open. If the hooks are closed, rings 177, 179 may be cut, assembled with respect to respective hooks 167, 169, 187, 189 and then brazed or welded closed. Having the hooks of any of the embodiments herein closed permits the fixture to be readily hung by merely removing it from any packaging and attaching the mounting assembly. If it is desired to maintain an orientation of the side lamp assemblies, square hooks 167', 169', 187', 189' and/or square rings 177', 179' may be used, as shown and oriented in FIG. 11 (and as shown and oriented in FIG. 12C).

Additional embodiments of the inventive light fixture are shown in FIGS. 12A-12C, 13, 14 and 15. Like the exemplary embodiment shown in FIGS. 8-11, the exemplary embodiments of FIGS. 12A-12C, 13, 14 and 15 may have a pair of side lamp assemblies being suspended below and at least one interior lamp assembly, with all of the shades of the lamp assemblies being the same shade or scaled versions of the same shade. The side lamp assemblies and interior lamp assemblies may all be pre-wired with wiring extending from the lamp assemblies to the mounting assembly, and extending from the mounting assembly for connection to wall wiring. Similarly, like the exemplary embodiments shown in FIGS. 1-11, the exemplary embodiments of FIGS. 12A-12C, 13, 14 and 15 all have at least one arm that extends outwardly along a wall from a central mounting assembly. In some of the embodiments, the at least one arm may extend outward from the central mounting assembly close to the wall (e.g., in the embodiment of FIGS. 12A-12C). In other embodiments (e.g., in the embodiment of FIGS. 13, and 14), the at least one arm may be spaced from the wall, e.g., spaced from the wall at about the same point from which lamp assemblies are suspended. The embodiment of FIGS. 8-11 has arms 126, 128 extending outwardly from the central mounting assembly close to the wall and another arm 150 spaced from the wall.

Figure 12A:
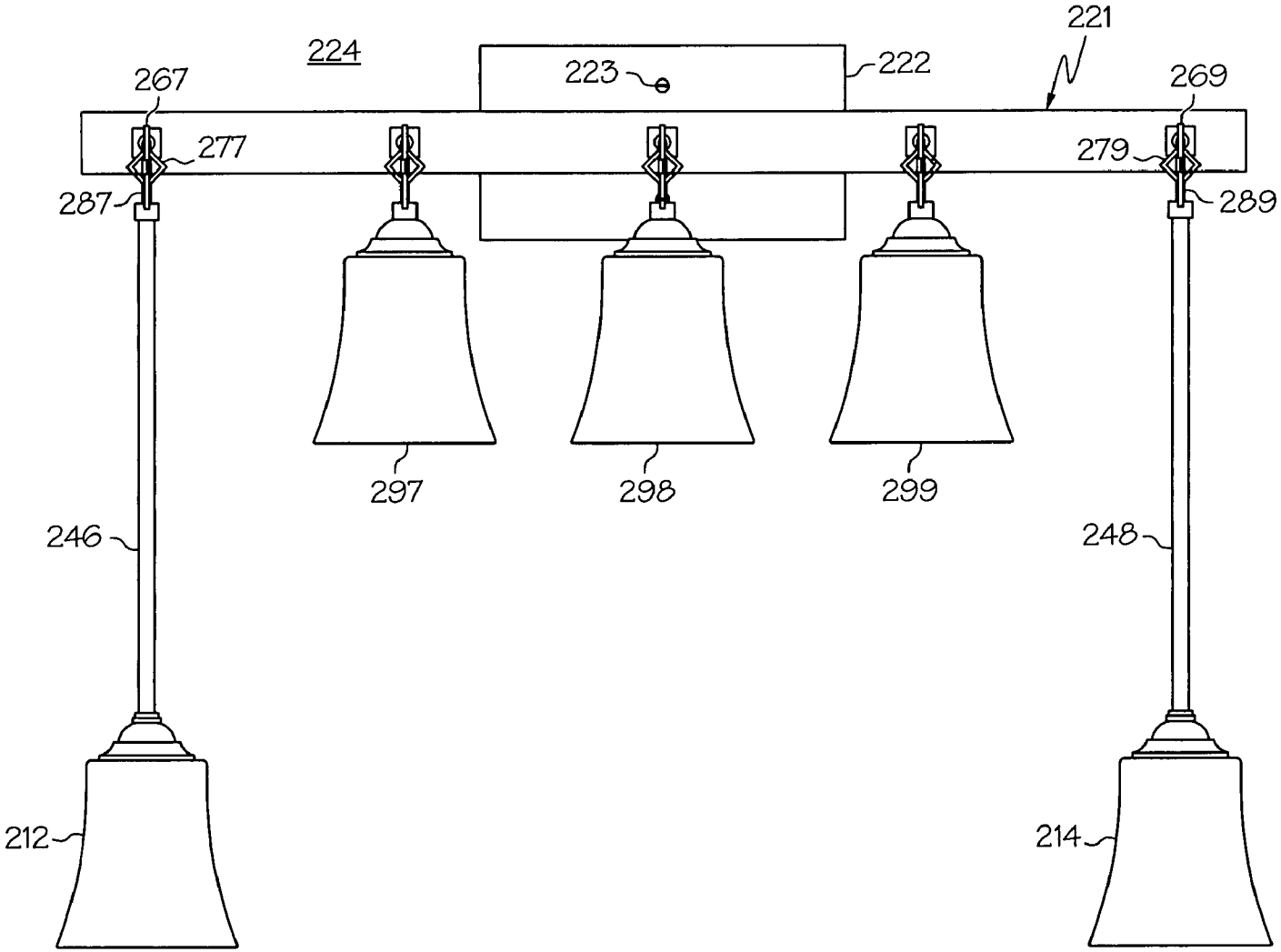
FIGS. 12A-12C are front, top, and side views illustrating yet another embodiment of the inventive light fixture.
Figure 12B:
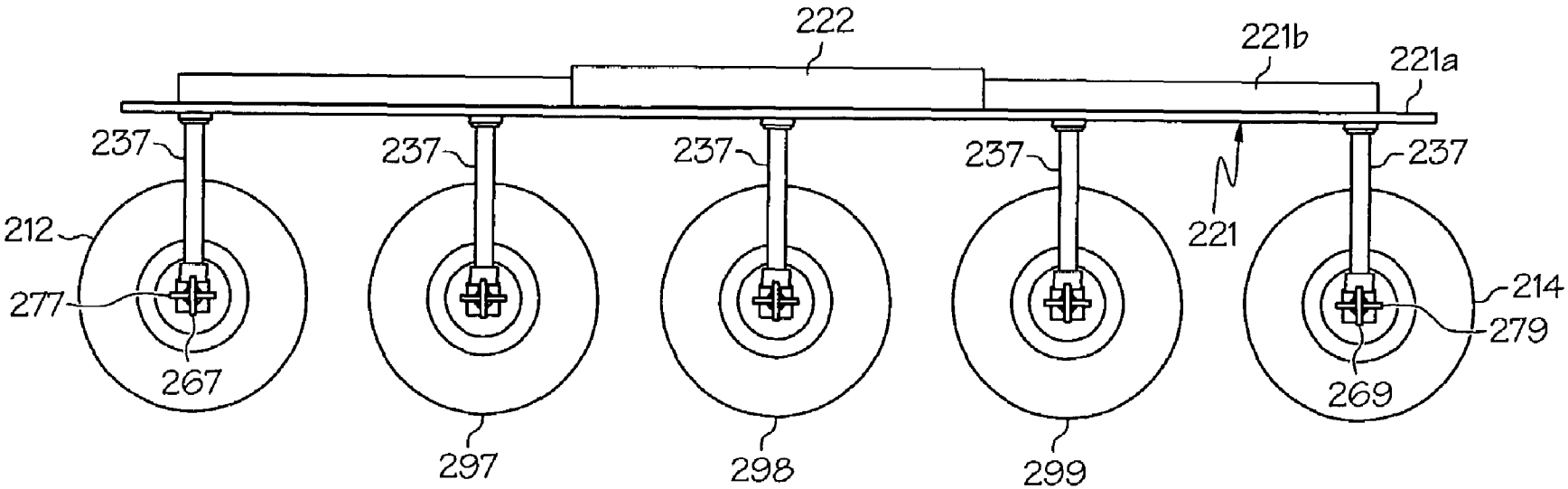
Figure 12C:
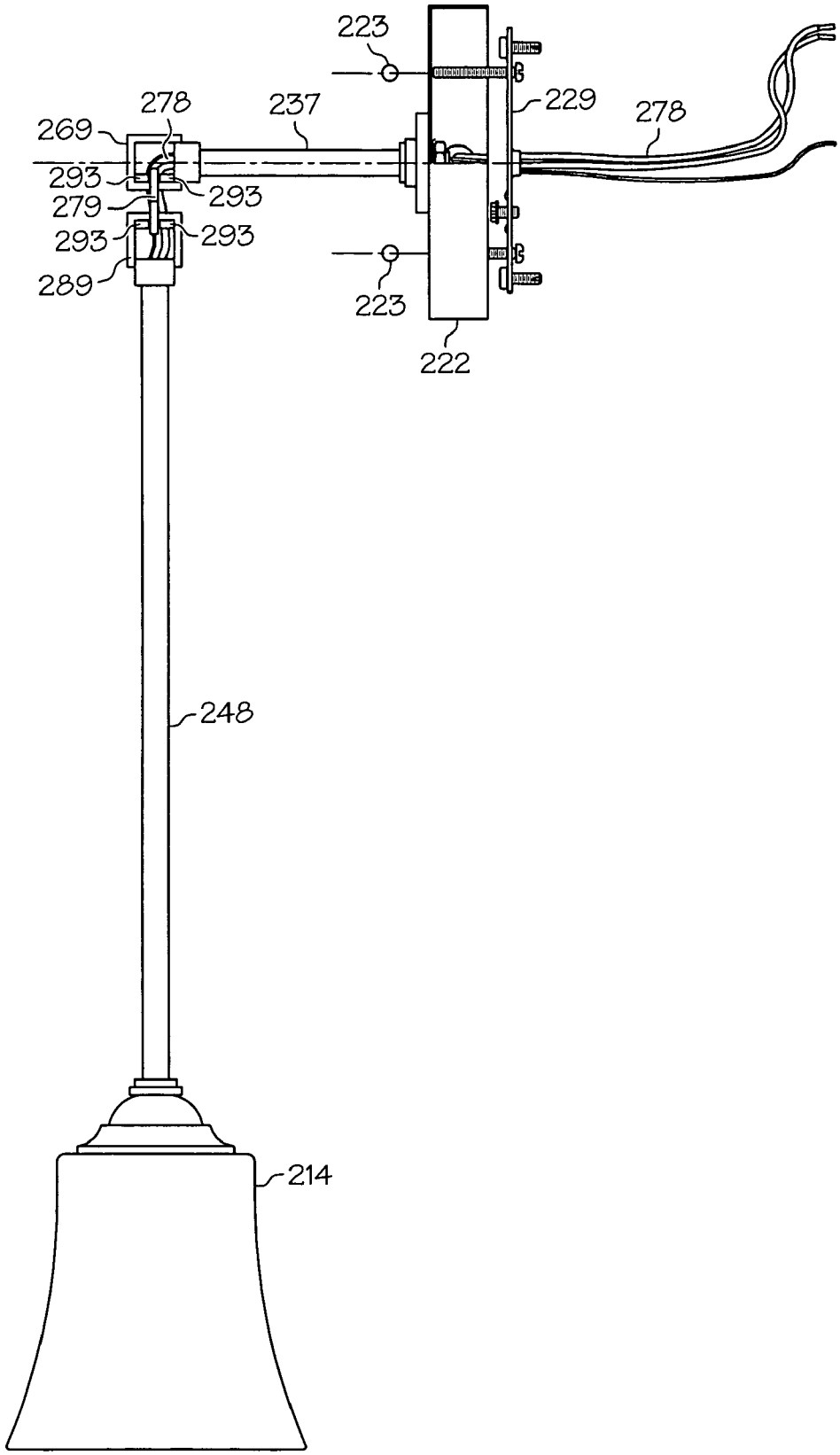

In the lighting fixture of FIGS. 12A-12C, the support arms are formed by a single, continuous, unitary support rod 221 which is essentially straight in configuration. The unitary support rod may be made from metal strap 221*a*, e.g., 3/16ths of an inch thick metal, with a backing of wireway tubing 221*b*. The two side lamp assemblies 212, 214 and the interior lamp assemblies 297, 298, 299 all depend from the front of the rod 221 via hollow, horizontal links 237 through which wiring 278 may extend to interior lamp assemblies 297, 298, 299 and to the two side lamp assemblies 212, 214 via connector links 246, 248. The horizontal links 237 and connector links 246, 248 may be made from square tubing. Mounting assembly 222 may be affixed to the wall 224 via any number of suitable fasteners, e.g., via slotted knurl finial balls 223 connected to a mounting plate 229. In this particular embodiment, carrier links 246 and 248 may be secured to the distal ends of the horizontal links 237 by a hook and link arrangement defined by hooks 267, 269, 287, 289 and rings 277, 279. The hooks may open or closed, as discussed above. Square hooks 267, 269, 287, 289 and/or square rings 277, 279 may be used to maintain an orientation of the lamp assemblies 212, 214, 297, 298, 299. As shown in FIG. 12C, guides 293 may optionally be used to maintain the lateral position of the rings 277, 279 with respect to the hooks 267, 269 and/or the hooks 287, 289. The carrier links 246 and 248 may be of a length so that the bottom of the shades of side lamp assemblies 212, 214 extend about 20 inches beneath a center of the mounting assembly 222 or a center of any of the horizontal links 237.

Figure 13:
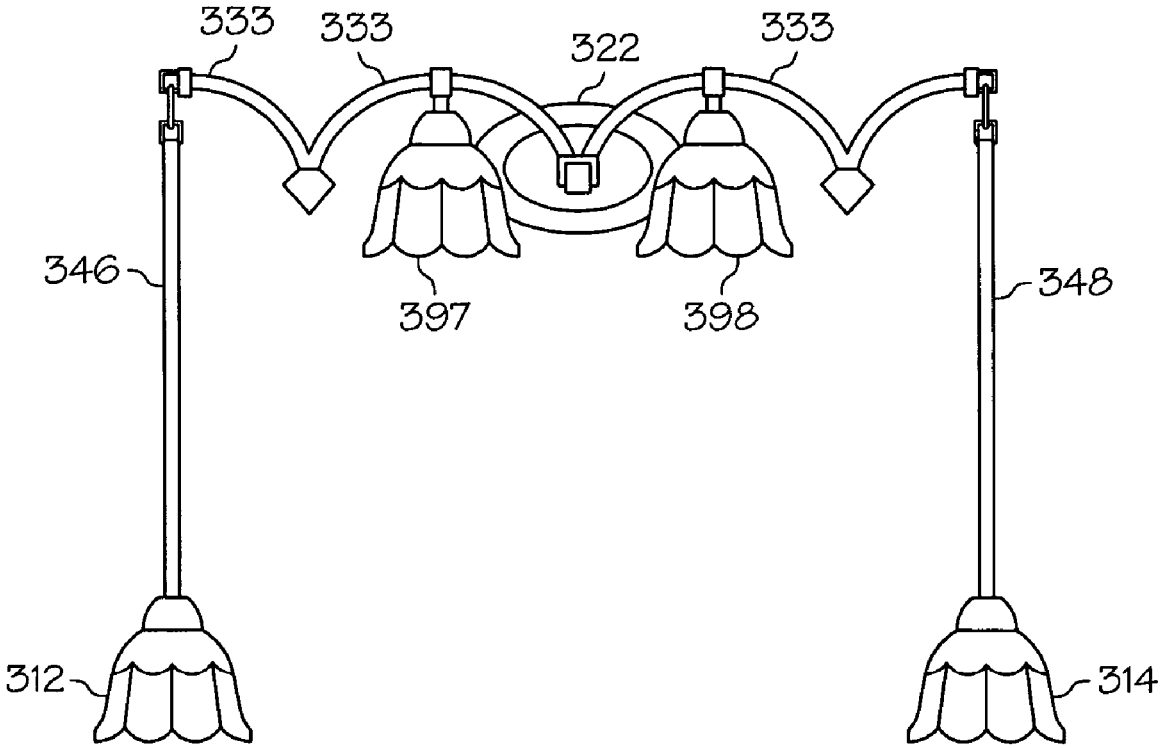
FIGS. 13, 14 and 15 are front views illustrating still further embodiments of the inventive light fixture.

In the lighting fixture of FIG. 13, the support arms are formed from multiple arcuate sections 333 with both the side lamp assemblies 312, 314 and interior lamp assemblies 397, 398 being attached at highpoints of respective arcuate sections.

In the lighting fixture of FIG. 14, the proximate ends of the support arms 446, 448 are attached to the top of mounting assembly 427 rather than in its middle. Finally, in the lighting fixture of FIG. 15, the interior lamp assemblies 596-599 are elevated relative to the attachment point of the support arms 546, 548 while the side lamp assemblies 512, 514 are attached near, but not at, the distal ends of the support arms.

In order to provide the impression and feel of multiple swag lamps, the side lamp assemblies of any of the embodiments may be suspended so that the lamp sockets inside these lamp assemblies (not shown) are located at least about 6 inches, more typically at least about 12 inches or even at least about 18 inches below a center of a junction box or mounting assembly or other location where the mounting assembly is attached to a wall or other surface.

The various structural components of the fixtures disclosed herein may be fabricated from any of several metals, e.g., steel, steel alloys, bronze, brass, chrome, and other materials with sufficient strength. The various components disclosed herein may be manufactured using common manufacturing techniques known to those skilled in the art.

Although only a few embodiments of the present invention have been described above, it should be appreciated that many modifications can be made without departing from the spirit and scope of the invention. For example, the particular structural features and design details described above may be used with virtually any type of lighting product (fixtures or portables). Similarly, although the fixtures have been presented in the context of a wall, the benefits of the fixtures herein may be used in other contexts, i.e., mounted to other support structures, e.g., a post for outside lighting. All such modifications are intended to be included within the scope of the present invention, which is to be limited only by the following claims:

We claim:

1. A lighting fixture for illuminating an object such as a mirror, a framed photograph, a framed painting, a framed image, or a window on a wall, the fixture comprising a mounting assembly for mounting the fixture to the wall above and at the approximate center of the object, left and right support arms being spaced from the wall and carried by the mounting assembly, a pair of side lamp assemblies, one side lamp assembly being suspended on each side of the object, and a pair of carrier links, each carrier link supporting an associated side lamp assembly, each carrier link being mechanically attached to its associated support arm by a quick-fit non-screw union.

2. The lighting fixture of claim 1, wherein the quick-fit non-screw union is formed by the link of a chain.

3. The lighting fixture of claim 1, wherein each support arm is a hollow elongated member defining a closed-walled downwardly facing opening for receiving its associated hollow carrier link.

4. The lighting fixture of claim 3, wherein the carrier links are hollow, the lighting fixture further comprising at least one wire for electrically connecting each lamp assembly to a source of electrical power, the wire or wires connected to each lamp assembly being carried inside the associated hollow carrier link.

5. The lighting fixture of claim 4, wherein the quick-fit non-screw union is one of a snap fit connection, a pin-fit connection and a twist connection.

6. The lighting fixture of claim 5, wherein each hollow rod is connected to its associated support arm by means of a hollow nipple having a lower end for joining to the hollow carrier link and an upper end for joining to the support arm, the quick-fit non-screw union being formed in either the upper end or the lower end of the nipple, the at least one electrical wire passing through the nipple.

7. The lighting fixture of claim 6, wherein the end of the nipple opposite the quick-fit non-screw union is threaded for being screw-fit into either the hollow carrier link or the support arm.

8. The lighting fixture of claim 7, wherein the quick-fit non-screw union is a pin-fit connection wire whereby the hollow carrier link is rotably mounted with respect to its associated support arm.

9. The lighting fixture of claim 3, wherein the support arms have proximal ends connected to the mounting assembly and distal ends remote therefrom, the support arms being shaped and connected to the mounting assembly so that their respective distal ends are spaced from the wall by a greater distance than their proximal ends.

10. The lighting fixture of claim 9, further comprising at least one interior lamp assembly mounted above and between the side lamp assemblies so that the side lamp assemblies are generally contiguous the left and right sides of the mirror while the at least one interior light assembly is generally contiguous the top of the mirror.

11. The lighting fixture of claim 10, wherein the at least one interior light assembly is attached to the mounting assembly, the support arms or both.

12. The lighting fixture of claim 11, wherein the support arms are formed from a continuous, unitary support rod.

13. The lighting fixture of claim 12, wherein the support rod defines a left end, a right end and a body section therebetween, the support rod being curved in configuration with its body section being attached to the mounting assembly.

14. The lighting fixture of claim 10, further comprising a secondary support rod extending between the distal ends of the support arms, the at least one interior lamp assembly being mounted on the support rod.

15. The lighting fixture of claim 9, wherein the support arms are formed from a continuous, unitary support rod, wherein the support rod defines a left end, a right end and a body section therebetween, and wherein the support rod is curved in configuration with its body section being attached to the mounting assembly.

16. The lighting fixture of claim 15, wherein the lamp fixture comprises only two lamp assemblies.

17. A lighting fixture for illuminating an object such as a mirror, a framed photograph, a framed painting, a framed image, or a window on a wall, the fixture comprising a mounting assembly for mounting the fixture to the wall above and at the approximate center of object, a pair of hollow support arms attached to the mounting assembly, each support arm defining a closed-walled downwardly facing opening a pair of side lamp assemblies, and a pair of hollow carrier links, each hollow carrier link supporting an associated side lamp assembly being suspended on each a side of the object, each hollow carrier line being mechanically attached to the downwardly facing opening of its associated support arm by means of a quick-fit non-screw union defined in a hollow nipple.

18. A lighting fixture comprising a mounting assembly for mounting the fixture to a wall, left and right support arms, each having a proximal end attached to the mounting assembly such that the distal end of each support arm is spaced from the wall when the mounting assembly is mounted on the wall, a pair of side lamp assemblies, one side lamp assembly being suspended below each support arm, and a pair of carrier links, each carrier link supporting an associated side lamp assembly from an associated support arm by a distance which is greater than the height of the associated side lamp assembly, each carrier link being mechanically attached to its associated support arm by a quick-fit non-screw union.

19. A lighting fixture comprising a mounting assembly for mounting the fixture to a support structure; and at least first and second hollow support arms extending in different directions away from the mounting assembly, each support aim having a proximal end attached to the mounting assembly) such that a distal end of each support arm is spaced a sufficient distance from the support structure when the mounting assembly is mounted to the support structure so that a lamp assembly supported at the distal end does not contact the support structure; and wherein the distal end of the first and second support arm each has an associated means for connection to and support of a respective carrier link via a quick-fit non-screw union, with each carrier link for supporting an associated side lamp assembly being suspended below an associated support arm.

20. The lighting fixture of claim 19 wherein the means for connection to and support of a respective carrier link via a quick-fit non-screw union comprises a downward-facing opening accepting a groove of a carrier link and further wherein the opening has an associated hole aligned with the groove and accepting a set screw to retain the carrier link by cooperation of the set screw with the carrier link groove.

* * * * *

UNITED STATES PATENT AND TRADEMARK OFFICE

CERTIFICATE OF CORRECTION

PATENT NO. : 7,354,171 B2
APPLICATION NO. : 11/033037
DATED : April 8, 2008
INVENTOR(S) : Bruce Raymond Pazula and Joseph John Janos It is certified that error appears in the above-identified patent and that said Letters Patent is hereby corrected as shown below:

Claim 5, column 7, line 13, after the word "twist" please insert -- -fit --.

Claim 16, column 8, line 1, after the word "the", please delete "lamp" and insert -- lighting --.

Claim 17, column 8, line 15, after the word "carrier" please delete "line" and insert -- link --.

Claim 19, column 8, line 38, after the word "support" please delete "aim" and insert -- arm --.

Claim 19, column 8, line 39, after the word "assembly" please delete ")".

Signed and Sealed this

Twenty-fourth Day of June, 2008

JON W. DUDAS
*Director of the United States Patent and Trademark Office*